US005094356A

United States Patent [19]

Miller

[11] Patent Number: 5,094,356

[45] Date of Patent: Mar. 10, 1992

[54] KNOCK DOWN BULK CONTAINER

[75] Inventor: Daniel R. Miller, Cincinnati, Ohio

[73] Assignee: Buckhorn Material Handling Group, Inc., Milford, Ohio

[21] Appl. No.: 609,719

[22] Filed: Nov. 13, 1990

[51] Int. Cl.[5] ..... B65D 6/18

[52] U.S. Cl. ..... 220/7; 220/326; 220/457; 206/600; 206/509

[58] Field of Search ..... 220/7, 416, 6, 326, 220/457; 206/600, 809, 503, 511

[56] References Cited

U.S. PATENT DOCUMENTS

| | | | |
|---|---|---|---|
| 1,155,161 | 9/1915 | Ramsey . | |
| 1,358,373 | 11/1920 | Johnson . | |
| 1,735,696 | 11/1929 | Ridley . | |
| 3,198,372 | 8/1965 | Witrant . | |
| 3,348,723 | 10/1967 | Wilson . | |
| 3,628,683 | 12/1971 | Friedrich . | |
| 3,796,342 | 3/1974 | Sanders et al. . | |
| 3,948,190 | 4/1976 | Cook, III; et al. . | |
| 3,968,895 | 7/1976 | Barnes, Jr. et al. . | |
| 4,043,476 | 8/1977 | Joseph . | |
| 4,062,467 | 12/1977 | Friedrich | 220/7 |
| 4,081,099 | 3/1978 | Shead . | |
| 4,192,430 | 3/1980 | Cornou . | |
| 4,320,845 | 3/1982 | Waller | 220/7 |
| 4,466,541 | 8/1984 | Tabler et al. . | |
| 4,591,065 | 5/1986 | Foy | 220/7 |
| 4,630,746 | 12/1986 | Fortenberry . | |
| 4,662,532 | 5/1987 | Anderson et al. | 220/7 |
| 4,673,087 | 6/1987 | Webb . | |
| 4,674,647 | 6/1987 | Gyenge et al. . | |
| 4,735,330 | 4/1988 | Hoss | 220/7 |
| 4,735,331 | 4/1988 | Keenan et al. . | |
| 4,775,068 | 10/1988 | Reiland et al. . | |
| 4,917,255 | 4/1990 | Foy et al. | 220/7 |
| 4,923,079 | 5/1990 | Foy | 220/7 |

FOREIGN PATENT DOCUMENTS

| | | |
|---|---|---|
| 2020581 | 4/1970 | Fed. Rep. of Germany . |
| 2272907 | 12/1975 | France . |
| 2405192 | 5/1979 | France . |
| 662432 | 5/1979 | U.S.S.R. . |
| 826578 | 1/1960 | United Kingdom . |

*Primary Examiner*—Joseph Man-Fu Moy

*Attorney, Agent, or Firm*—Fay, Sharpe, Beall, Fagan, Minnich & McKee

[57] ABSTRACT

A knock down bulk container has side and end panels hinged to a base. In assembling the container for use, first the end panels are uprighted to a substantially vertical position, and then the side panels are swung to an upright position. As the side panels are swung into their upright position, lift pins formed to protrude laterally outwardly from each side edge of the side panels engage a lift track in an end wall of the base to raise each of the side panels vertically with respect to its hinge axis. To connect the panels together, the end panels are formed with pockets along their edges adjacent the corners of the container, and the side panels have hooks that are seated within the pockets of the end panels. As the side panels are swung into their upright position, the hooks are positioned vertically above the pockets by the engagement of the lift pins with the tracks. Once in the vertical position, the lift pins disengage from the tracks and the side panels drop downwardly to seat the hooks within the pockets to form the corners of the container.

20 Claims, 12 Drawing Sheets

KNOCK DOWN BULK CONTAINER

BACKGROUND OF THE INVENTION

FIELD OF THE INVENTION

The present invention relates to a bulk container having a base with side and end panels that are pivotally mounted to the base. The panels lie flat during shipment, and then are uprighted and joined at their corners to form end and side walls of the container when the container is assembled for use. The container is stackable during shipment in its unassembled state and stackable in use, and further assembled and unassembled containers can be interstacked.

Knock down bulk containers are known, and have the advantage that the side and end walls of the container can be erected when the container is to be used, but otherwise the container can be shipped or stored in an unassembled state to save space.

Conventional bulk containers of the knock down type suffer from many disadvantages, particularly with regard to manufacturing the container in a minimum number of pieces that can be efficiently assembled together, both in the initial assembly of the container when it is formed in the knock down state, and in the final steps of assembly when the container is erected for use. The container parts are molded of a synthetic resin material. In the initial assembly steps, the side and end panels are hinged to the base along its edges. These hinged joints must then function to permit the side and end panels to be swung into an upright position in the steps performed later to assemble the container for use. Furthermore, the hinged joints must withstand the loading forces of the material contained within the bulk box once it is assembled.

Knock down or collapsible type containers also suffer from the disadvantage that they are difficult to assemble when they are ready to be used. In particular, the connecting structure provided to form the corner joints is frequently difficult to assemble in that more than one person is required to complete the task, thereby detracting from the efficient assembly of the container by the end user.

SUMMARY OF THE INVENTION

It is an object of the invention to provide a bulk container that is shipped and stored in a knock down state and assembled when needed for use as a container. The side and end walls are pivotally mounted to the base along the edges of the base. A full sized container can be formed by erecting each of the side and end wall panels of the container to their upright position, and by joining the adjacent panels together at the corners of the container.

It is an object of the invention to enable the side and end panels of the container to be pivotally mounted to the base by hinge elements that are sturdy and readily manufacturable by synthetic resin molding technology. In particular, in manufacturing the knock down bulk container of the present invention, it is preferred that the steps performed for uniting the base and the end and side wall panels together be reduced to a minimum so that the knock down bulk container can be efficiently and economically manufactured.

It is an object of the invention to pivotally mount the end and side walls of the container to the base along the edges of the base so that the container can be easily formed or assembled by uprighting the walls with a minimum of effort. Preferably, the first set of panels to be uprighted remain erect while the second set of walls is uprighted by providing a detent structure between the first set of panels and the base. Further, the second set of panels to be uprighted are mounted and guided when uprighted so that the corner joints are securely formed between the first and second sets of panels by swinging the second set of panels into place with respect to the first set of panels.

It is a further object of the invention to form the corner joints of the bulk container with interengaging hook and pocket corner connectors. The hooks of one set of panels enter the pockets of another set of panels vertically and are seated within the pockets by continued relative vertical movement of one set of panels with respect to the other. It is preferred that the second set of panels to be erected engage a cam surface or track so that the panels are raised vertically with respect to the first set of panels as they are swung into the erected position. This causes the hooks to be raised into position in vertical alignment with the pockets. Then, when the second panels are fully uprighted, the panels disengage the cam surface or track so that the hooks fully engage with the pockets to form the corners of the container. It is a further object of the invention to provide each of the hooks with a tapered or wedge shaped terminal portion that engages the pocket in which it is seated to lock them together.

It is an object of the invention to provide access to the interior of the container through a gate that can be opened when the container is in the middle of a stack of several containers. It is further an object of the invention to enable the gate to be opened without requiring a latch to be operated in order to open the gate. It is yet a further object of the invention to mount the gate by a hinge element to one of the panels so that when the gate is opened and access is provided into the interior of the container, the gate hangs downwardly flush or coplanar with the panel to which it is mounted.

It is an object of the invention to provide a base for the bulk container that is suitable for use with a forklift. In particular, with respect to synthetic resin molding of the base, the feet that engage the surface on which the container is supported are cored from the top and have metal reinforcing straps extending along their ground engaging surfaces. Preferably, each of the reinforcing straps is able to be manufactured of a uniform length and secured to span the feet of the base of the container after the container base has been molded. Furthermore, in order to accommodate handling by a forklift, the sides of the feet are preferably reinforced by a metal strike plate that reinforces the feet from possible damage caused by impact with the tines of a forklift.

It is yet a further object of the invention to enable the bulk containers to be stacked on one another whether assembled or unassembled in the knock down state by providing L-shaped corner flanges that open outwardly at the top of each of the corners of the container. The corner flanges are provided at upper portions of corner posts of the base for stacking unassembled containers or containers in the knock down state and at the corners formed between adjacent upper portions of the side and end walls of the base for stacking fully assembled containers. The feet at the corner portions of the base have bottom structure that cooperates or engages with the L-shaped flanges to permit the stacking of both assembled and unassembled containers.

DETAILED DESCRIPTION OF THE PREFERRED EMBODIMENTS

Figure 1:
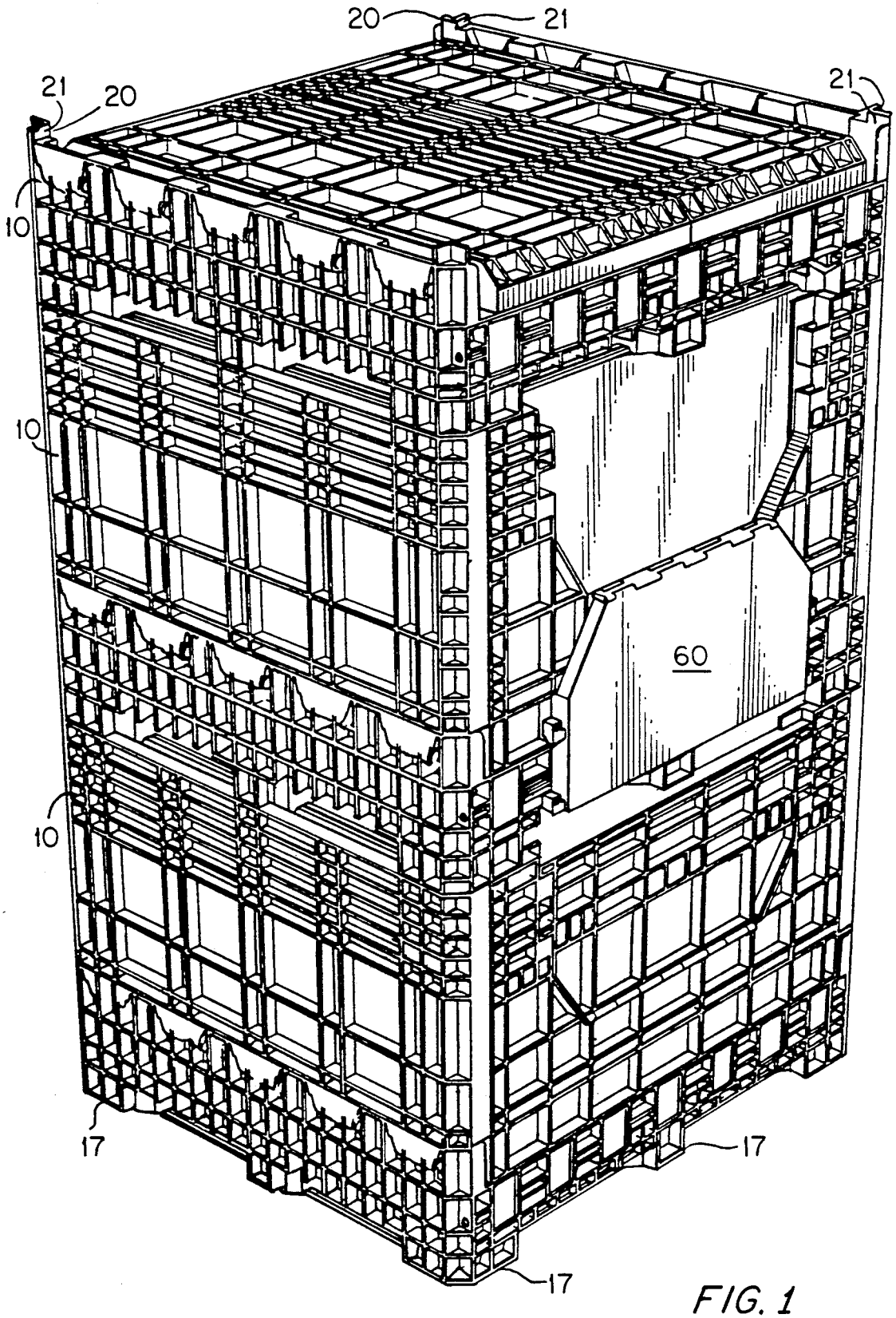
FIG. 1 is a perspective view of two assembled bulk containers constructed according to an embodiment of the present invention with a third unassembled bulk container stacked on top.

FIG. 1 is a perspective view of three knock down bulk containers 10 of the present invention wherein the uppermost container is in the knocked-down or unassembled state and the bottom two containers have been erected for use.

The containers have an open top, a base 11, end walls formed of end panels 18 that are substantially similar, and side walls formed of similar side panels 24 and 25. Side panel 25 has a gate 60 that allows access to the interior of the container when another container is stacked on top, as shown in FIG. 1.

Figure 2:
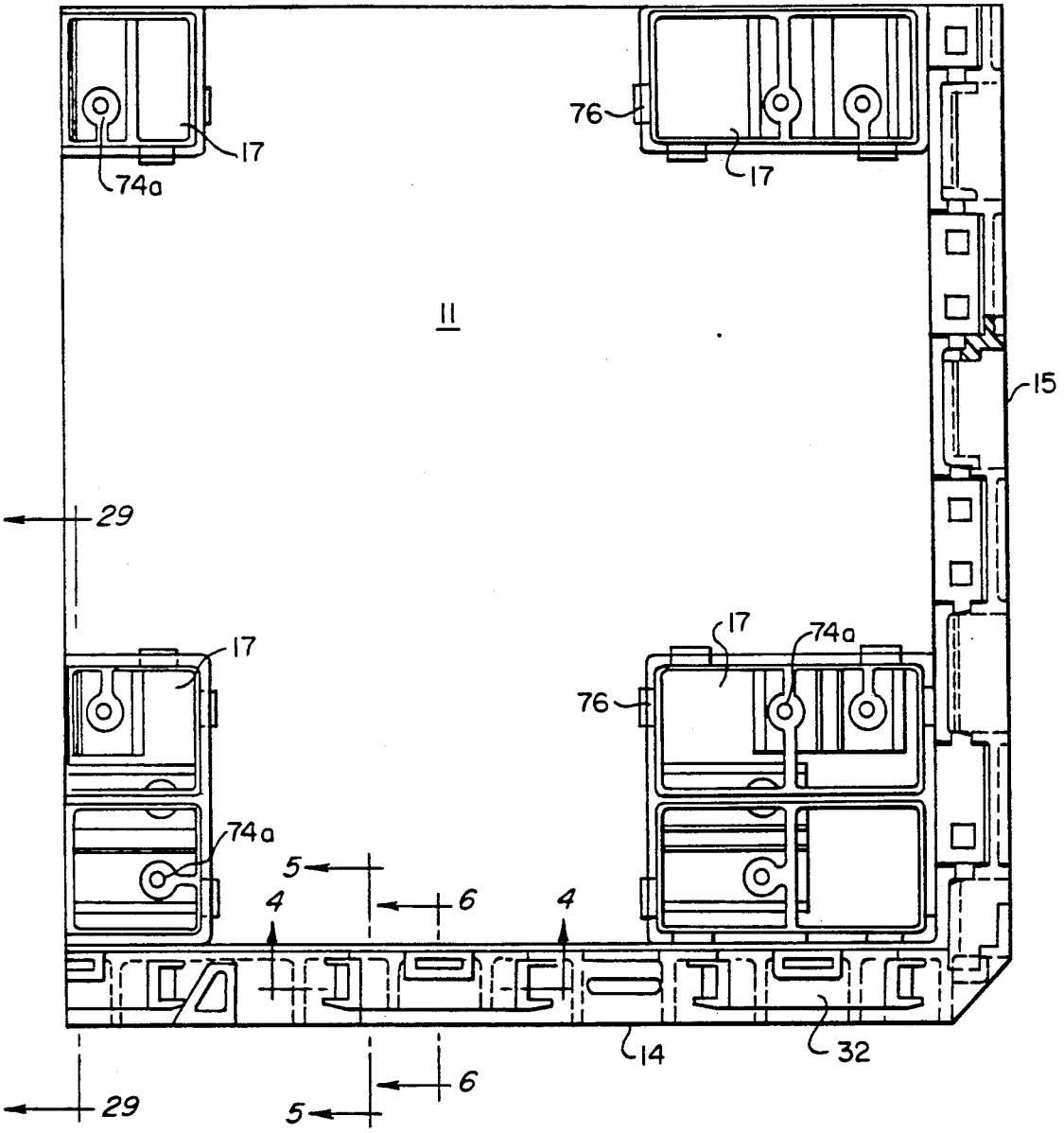
FIG. 2 is a partial plan view of the base of the bulk container showing details of one half of each of the side and end walls and one quarter of the bottom wall of the base with the remainder of each wall not shown, but being constructed in mirror image thereof.
Figure 3:
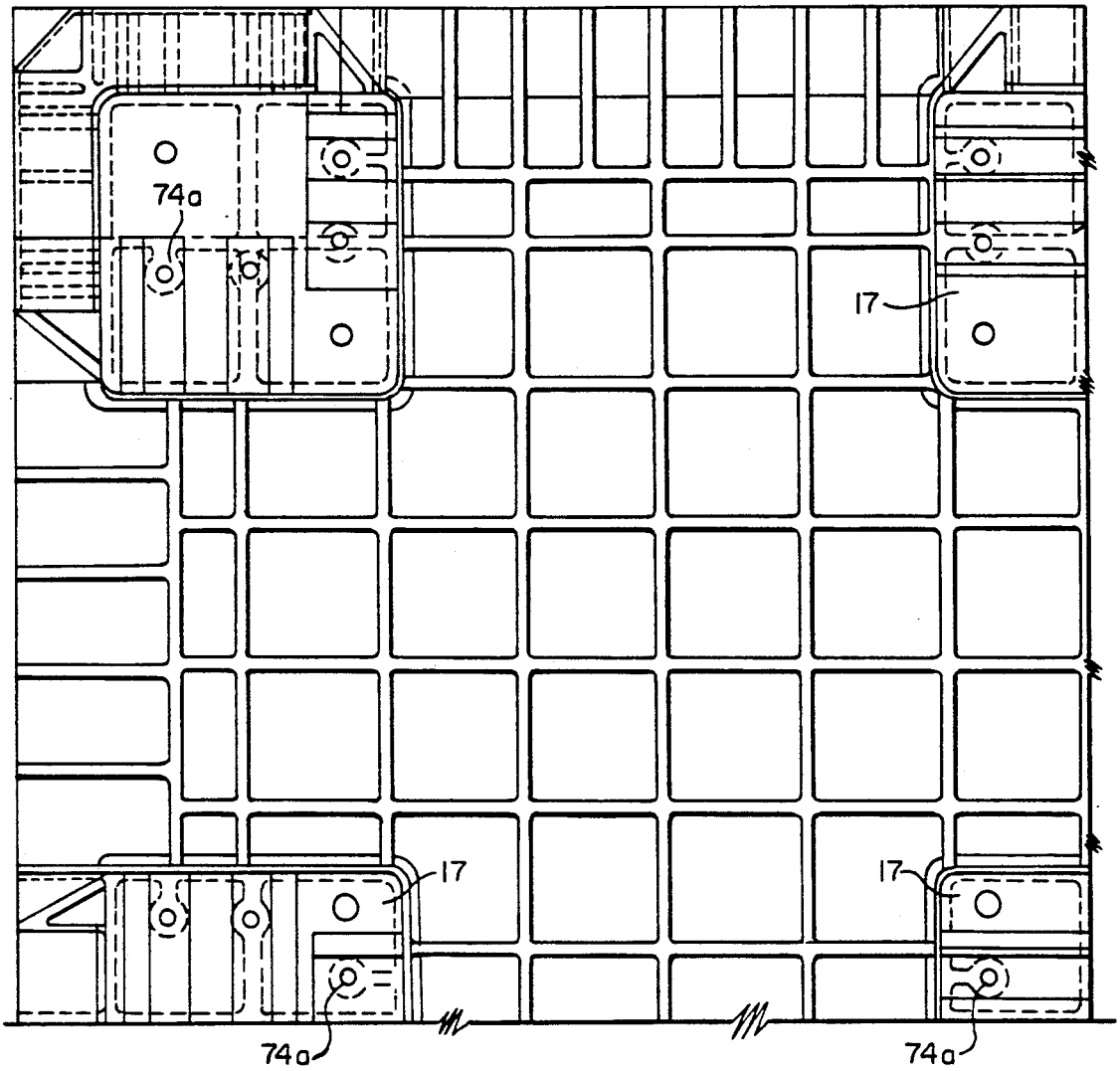
FIG. 3 is a reverse plan view of a portion of the base with respect to FIG. 2.

The base 11 of the container has a bottom wall 16, as shown in FIGS. 2 and 3, oppositely facing end walls 14 and oppositely facing side walls 15 adjacent the end walls. The base also has feet 17. FIG. 2 shows an interior view of the base and bottom wall 16 and FIG. 3 shows an exterior view of the base and bottom wall 16. It is understood that each of FIGS. 2 and 3 show only one-fourth of the base structure, with the remainder being in mirror image of the quarter portion shown. Preferably, for example, it is apparent that nine feet 17 are provided for supporting the container.

Figure 4:
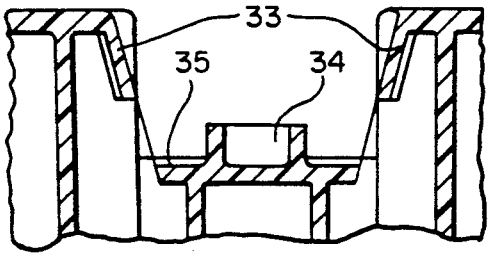
FIGS. 4, 5 and 6 are partial sectional views of the end wall of the base taken along lines 4—4, 5—5 and 6—6 of FIG. 2, respectively.
Figure 7:
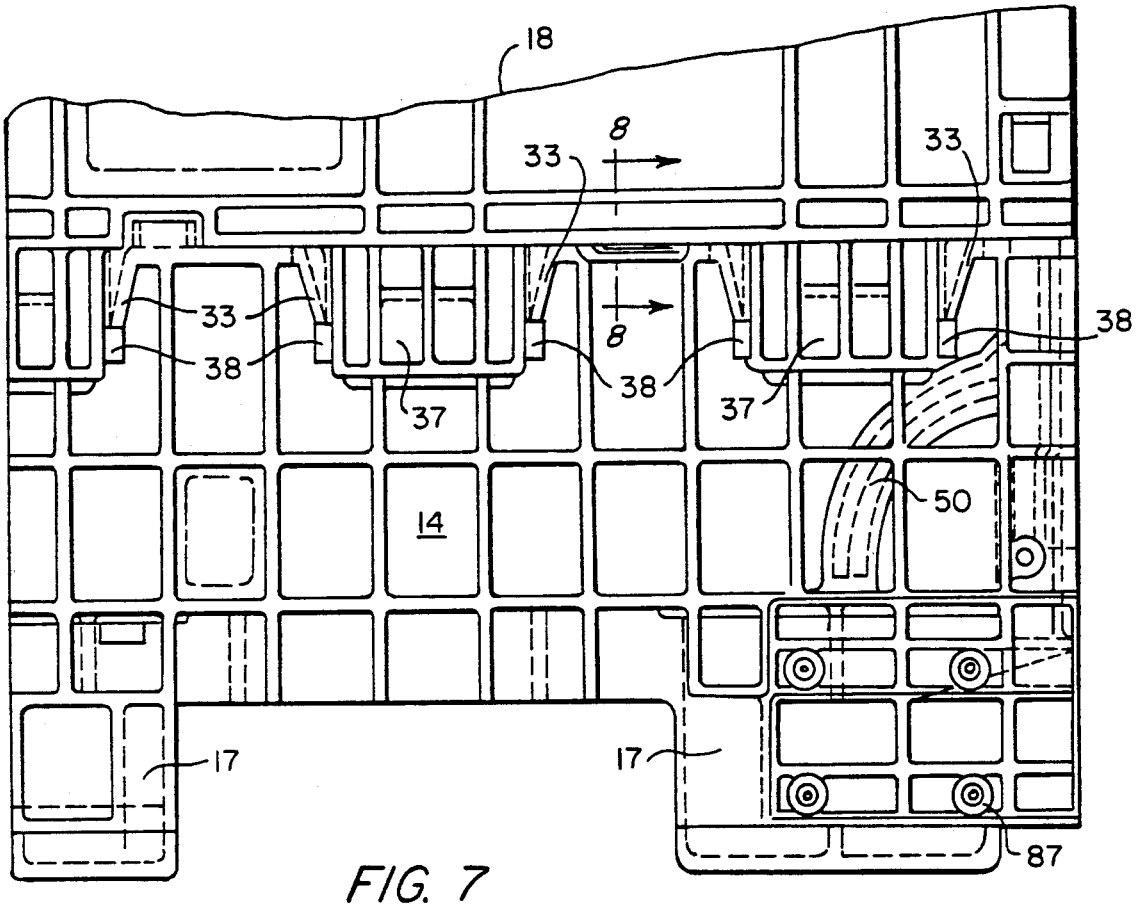
FIG. 7 is an end elevational view showing a portion of the end wall of the base with a bottom portion of part of an end panel shown connected thereto.
Figure 8:
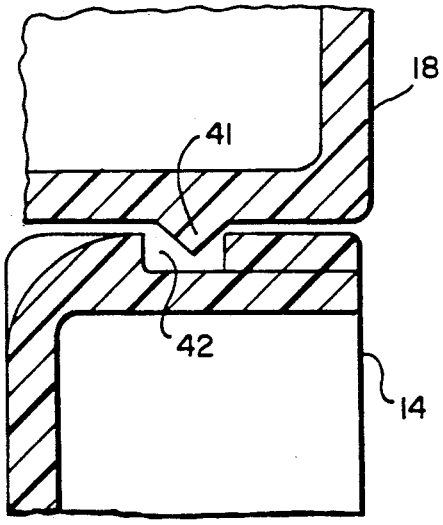
FIG. 8 is a sectional view taken along line 8—8 of FIG. 7.
Figure 13:
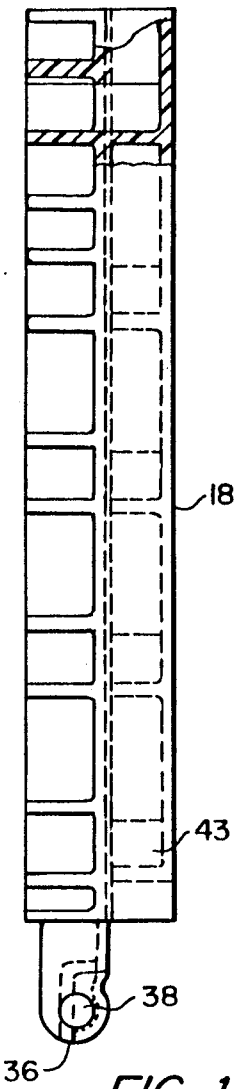
FIG. 13 is a side view of the end panel shown in FIG. 9.
Figure 9:
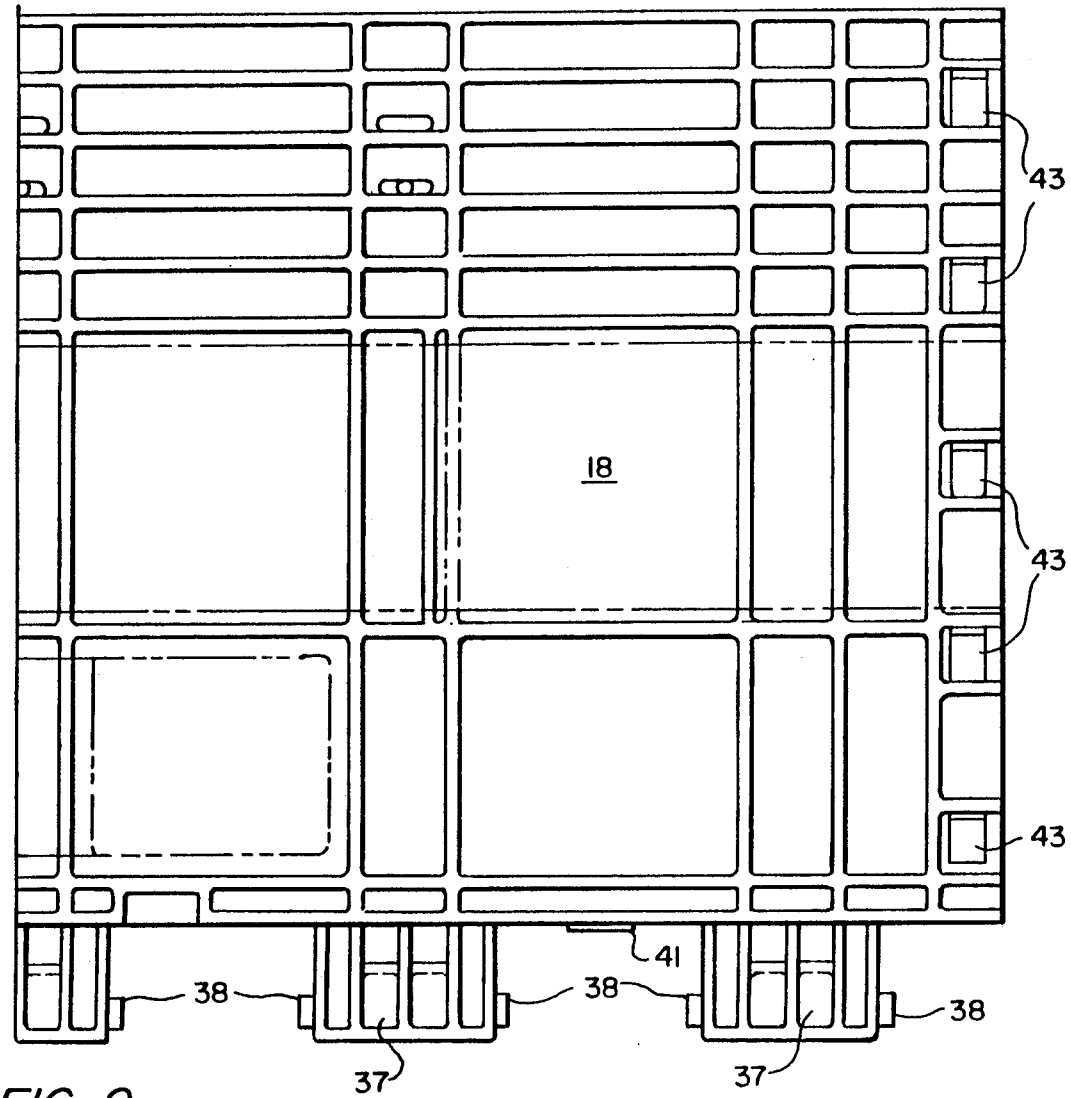
FIG. 9 is a view of one half of an end panel in elevation.
Figure 10:
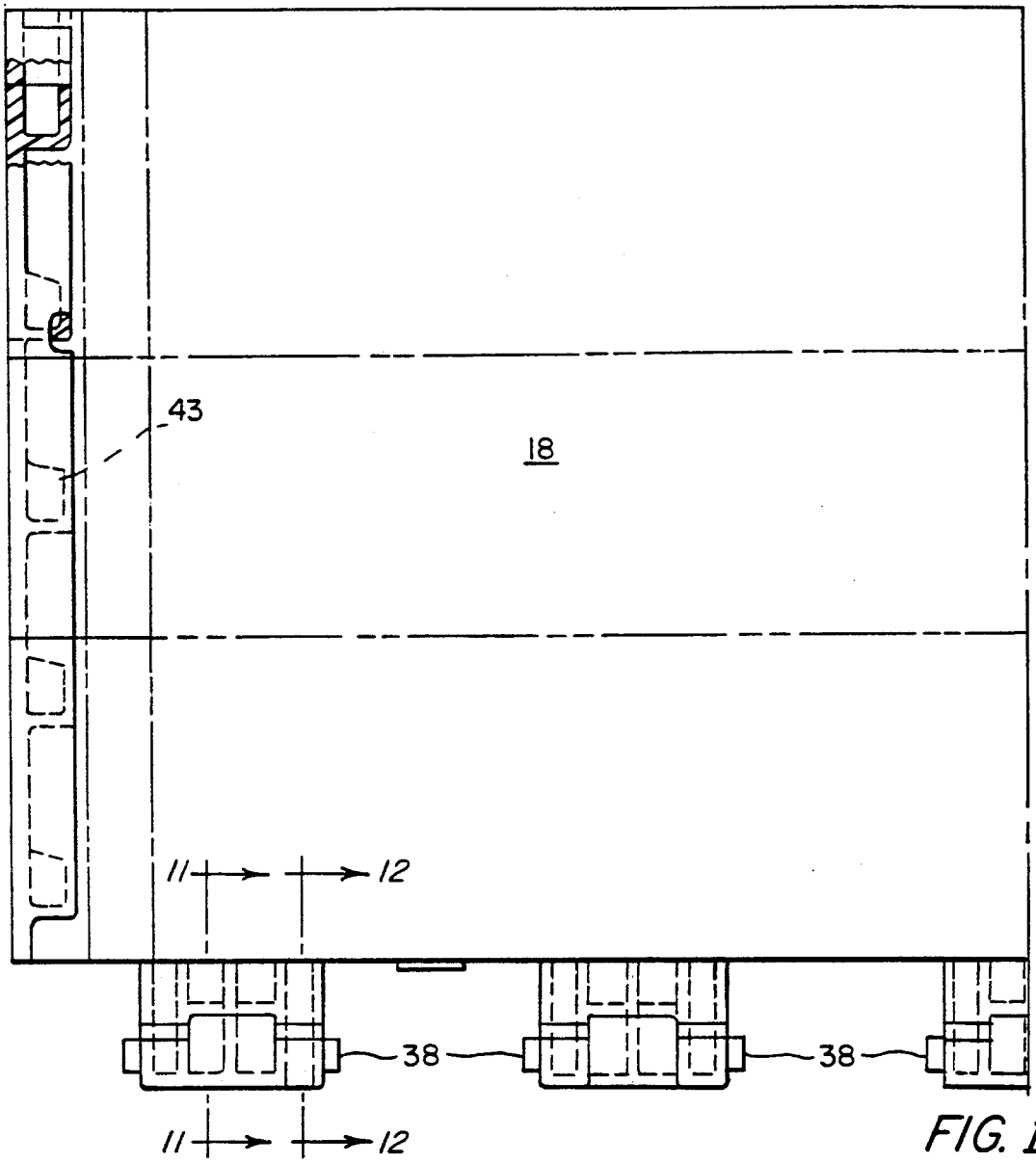
FIG. 10 is a reverse view with respect to FIG. 9 of one half of an end panel in elevation.

Preferably, the container is manufactured from injection molded synthetic resin in parts that are initially assembled together in the knocked-down state, shown at the top of the stack of containers in FIG. 1. The end panels 18 and side panels 24, 25 are hinged to the edges of the base along the end walls 14 and side walls 15 of the base, respectively, so that the panels can be uprighted by swinging them into a substantially vertical position. By the present invention, discussed in greater detail herein, the corner joints between the panels are formed by merely swinging the side panels into position with respect to the end panels after the end panels have been erected. The end walls 14 of the base 11 have a plurality of recesses 32, shown in FIGS. 4 and 7, that receive pintles of the end panels 18. The recesses 32 have flanges 33 at opposite ends of the recesses that are cantilevered and adapted to be resiliently deformed as the pintles 37 are forced into the recesses. In particular, the pintles 37 have pins 38 that flex the flanges 33 outwardly as the pintle is driven downwardly into the recess. As shown in FIG. 7, the pins 38 are forced downwardly into the recesses beyond the ends of the flanges so that the flanges snap or flex back into position to capture the pins and hold the pintles into the recesses.

Figure 5:
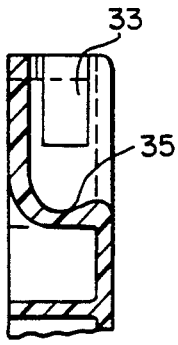
Figure 6:
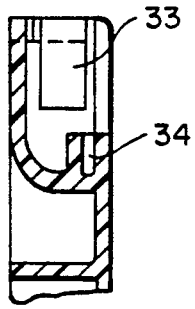
Figure 11:
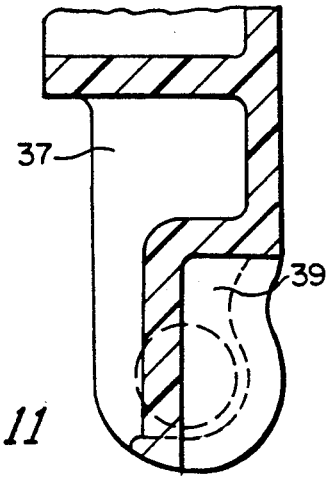
FIGS. 11 and 12 are partial sectional views taken along lines 11—11 and 12—12 of FIG. 10, respectively.
Figure 12:
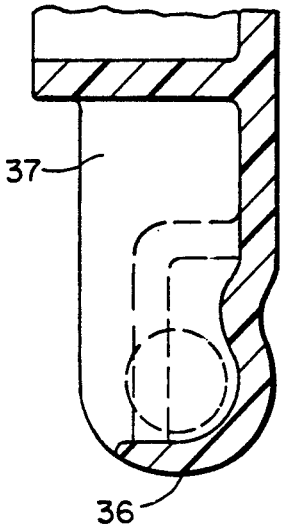

As shown in FIGS. 5 and 6, the recesses have a rounded bottom wall surface 35 that receives a correspondingly shaped bearing surface 36 of the end panel pintles 37, as shown in FIGS. 11 and 12. This permits a smooth pivoting movement of the end panels when they are uprighted into a substantially vertical position for assembling the container for use. As further shown in FIGS. 11 and 12, each of the pintles has an opening 39 between the pins that receives a corresponding buttress flange 34 formed on the end wall 14 of the base for strengthening the hinge joint against impact or forces applied from the exterior of the container.

FIG. 7 shows the end panels with pintles 37 engaged in the recesses 32 and an end panel 18 swung into a substantially vertical upright position. In assembling the container for use, the end panels are swung into the vertical position first, and held in this position by a detent. For example, a V-shaped rib 41 is provided along a bottom portion of the end panel to engage a correspondingly positioned groove 42 provided along a top portion of the base end wall. This prevents the end panels from falling once erected during final assembly of the container.

Figure 14:
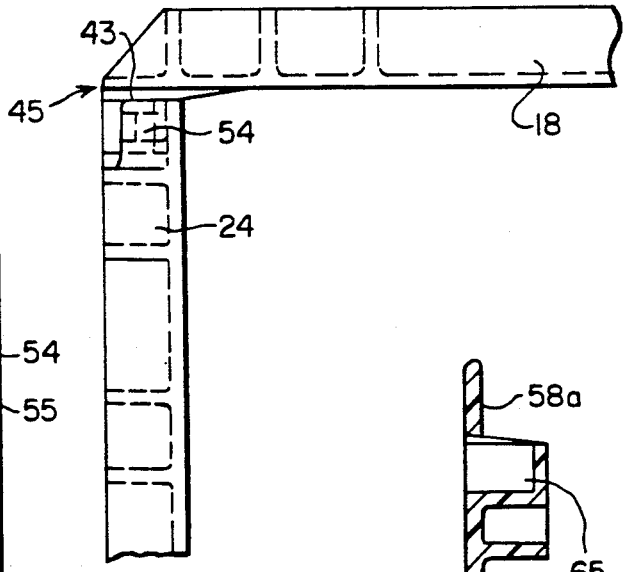
FIG. 14 is a top view of an end panel according to FIG. 9 joined to a side panel at a corner of the bulk box.
Figure 19:
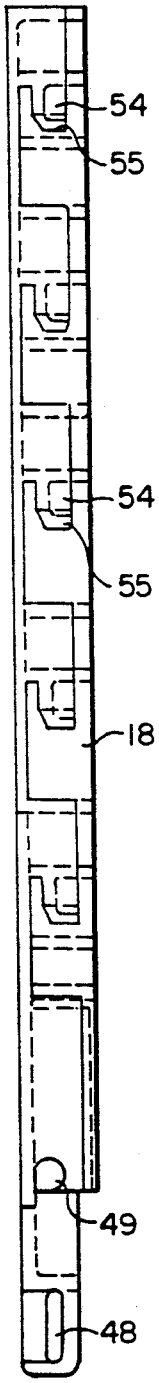
FIG. 19 is a side view in elevation of the side panel shown in FIG. 18.

As shown in FIGS. 9, 10, 13 and 14, the end panels have pockets 43 extending along an inwardly facing edge 44 of the panels that receive correspondingly shaped hooks 54 of the side panels 24, 25 to form corners 45, as shown in a top plan view, in FIG. 14.

Figure 23:
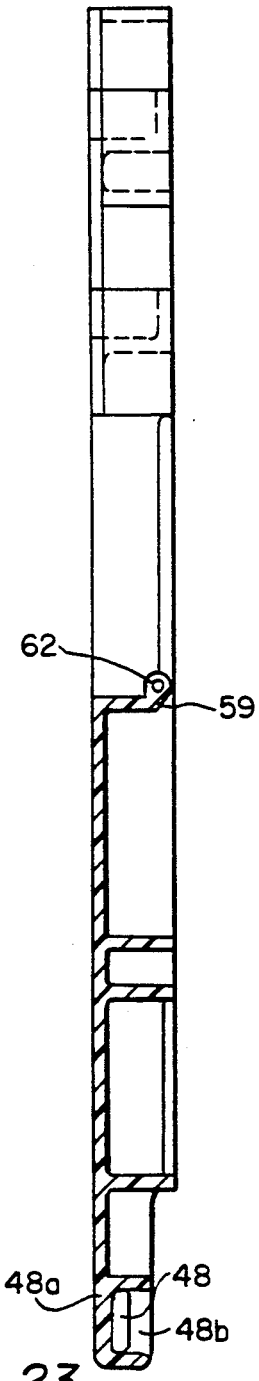
Figure 15:
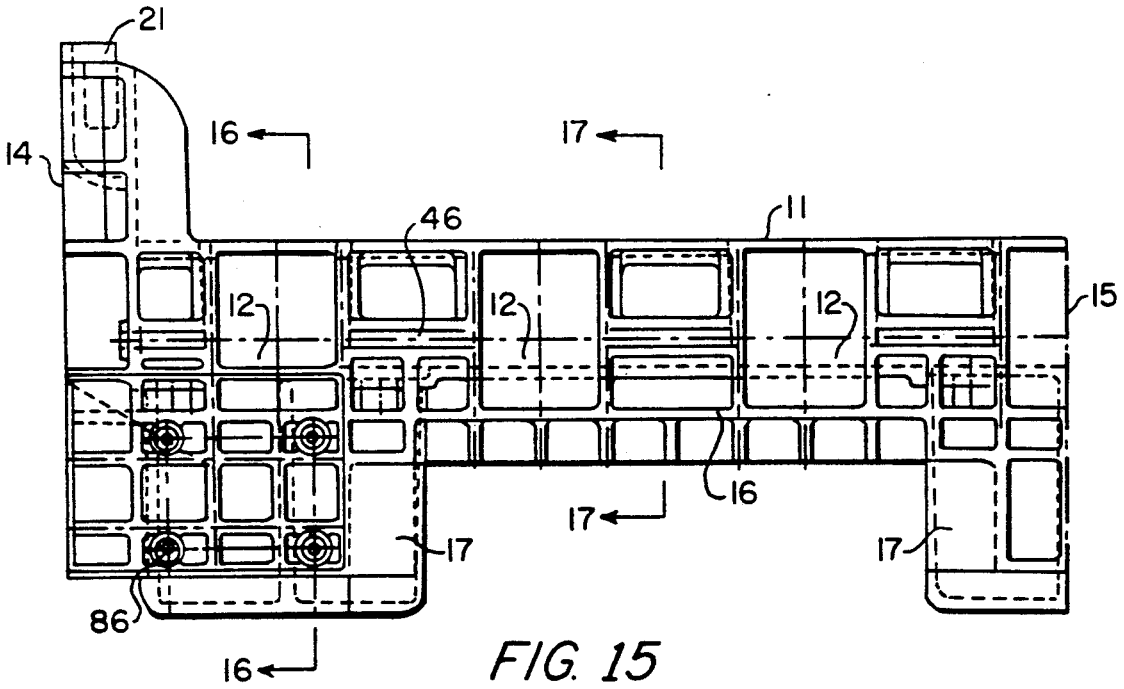
FIG. 15 is a side elevational view of one half of the side wall of the base.
Figure 18:
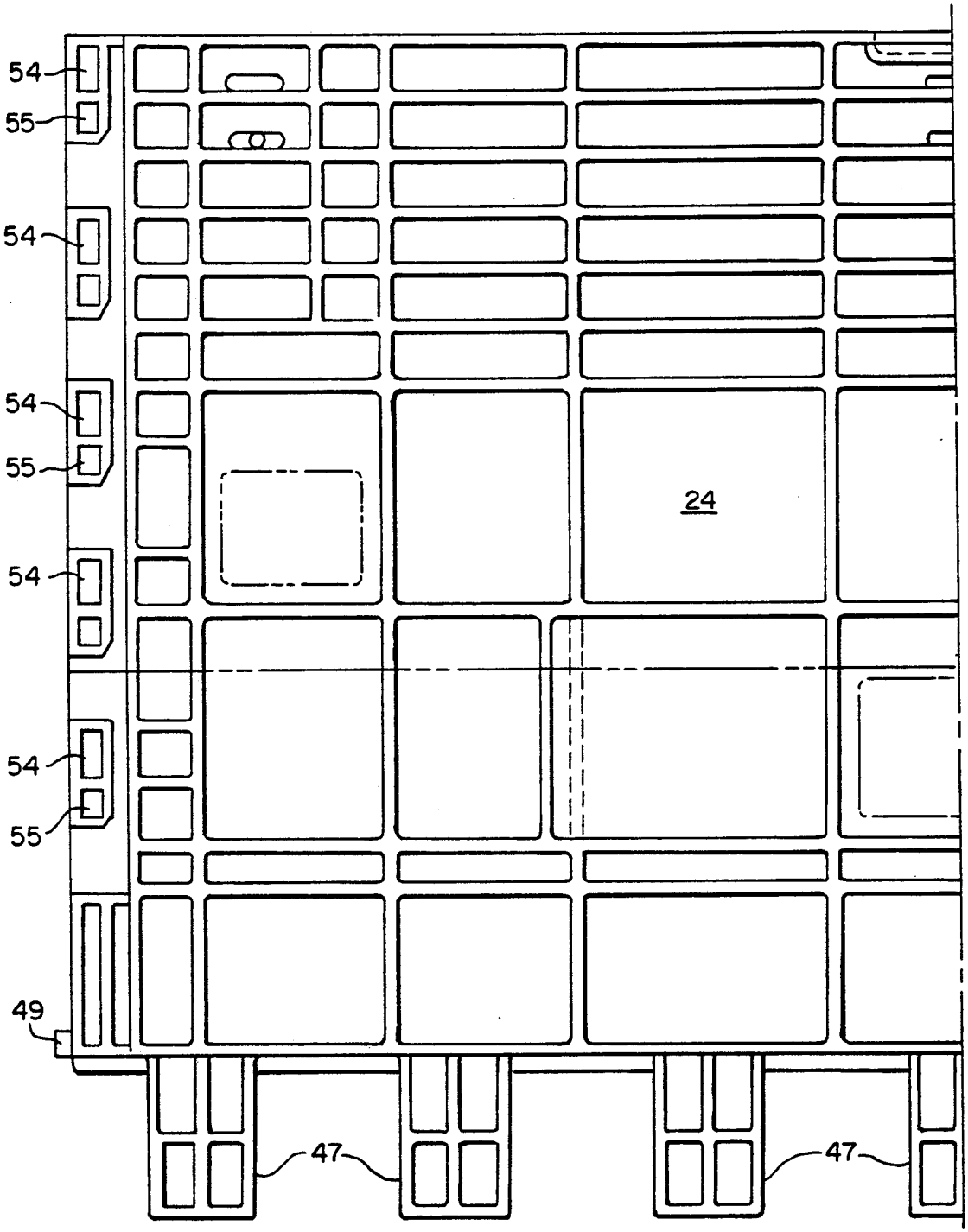
FIG. 18 is a view in elevation of one half of one side panel of the bulk box.
Figure 21:
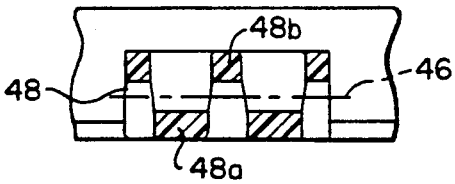
Figure 27:
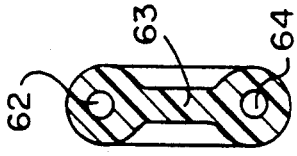
FIGS. 25, 26 and 27 are partial sectional views taken along lines 25—25, 26—26 and 27—27 of FIG. 24, respectively.

The side panels are of a substantially similar construction, but side panel 25 differs from side panel 24 in that an opening is provided for a gate 60. The side panels have journal portions 47 with an elongated slot 48 to permit them to be raised vertically while being pivoted. The elongated slots 48 receive therein a hinge pin, not shown, that extends along hinge axis 46. The slot 48 is molded in the journal portions of the side panels by providing alternating oppositely facing U-shaped portions 48*a* and 48*b*, as shown in FIGS. 21 and 23. When the side panels are erected to extend substantially vertical, the journal portions 47 are received within recesses 12 formed in the side walls 15 of the base 11, as shown in FIGS. 15, 16 and 17.

Each of the side panels is erected to assemble the container for use after the end panels 18 have been swung into their upright position. The corner joints are formed by engaging the hooks in the pockets, which requires no additional latching structure or tools. To form the corners 45 of the container, the hooks 54 of the side panels 18 are vertically aligned above the pockets 43 of the end panels, and then the end panels are dropped downwardly to securely seat the hooks into the pockets.

To align the hooks vertically above the pockets, the side panels are raised or moved outwardly from their hinged connection to the base as they are swung into their upright position. This movement is permitted since the elongated slots of the journal portions 47 allow relative movement of the side panels to occur in a direction perpendicular to hinge axis 46. To raise the side panels as they are uprighted, lift pins 49, which protrude from each edge of the side panels, are received in tracks 50, which are formed along an interior portion of each of the end walls 14 of the base.

Figure 16:
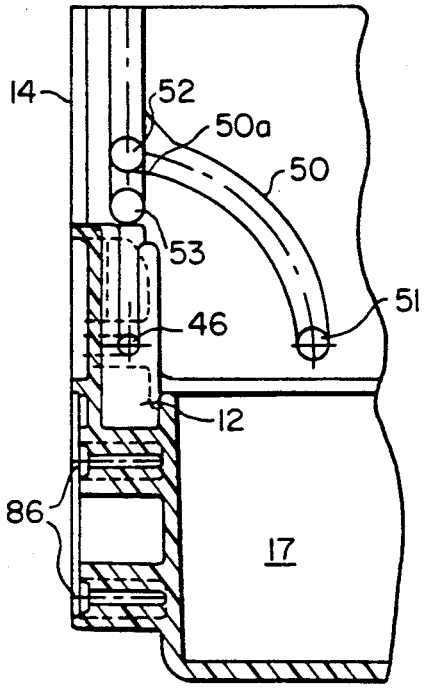
FIGS. 16 and 17 are partial sectional views of the side wall of the base taken along lines 16—16 and 17—17 of FIG. 15, respectively.
Figure 17:
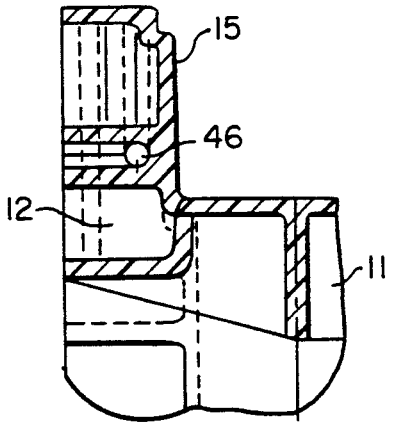

FIGS. 7 and 16 show one of the tracks 50. As a side panel is uprighted, the pins slide along the tracks lifting the panel upwardly to position the hooks above the corresponding pockets. In FIG. 16, the positions that the lift pins of the side panels take as the panels are uprighted are shown. Initially, the side panels lay flat along the bottom wall of the base with the lift pins in the position shown at 51. As the panels are swung upwardly, the pins move within the tracks to position 52, whereupon the hooks of the side panels are raised and brought into alignment with the pockets of the ends panels. Then, the pins travel to the end 50*a* of the tracks causing them to drop downwardly to position 53, allowing the side panels to correspondingly drop downwardly and seat the hooks within the pockets. The hooks 54 have tapered or wedged lower portions 55 so that once the hooks have been seated within the pockets 43 of the side panels, the hooks are not easily displaced from the pockets.

Figure 22:
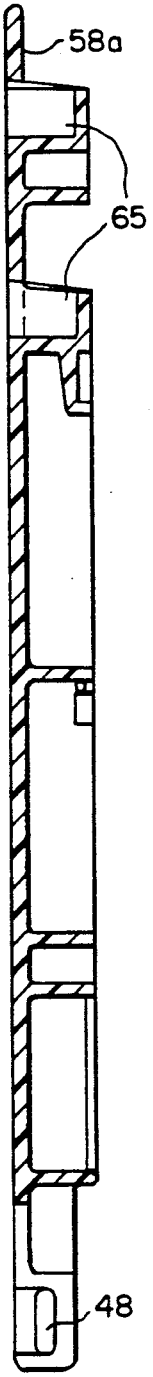
FIGS. 21, 22 and 23 are partial sectional views taken along lines 21—21, 22—22 and 23—23, respectively, of FIG. 20.
Figure 20:
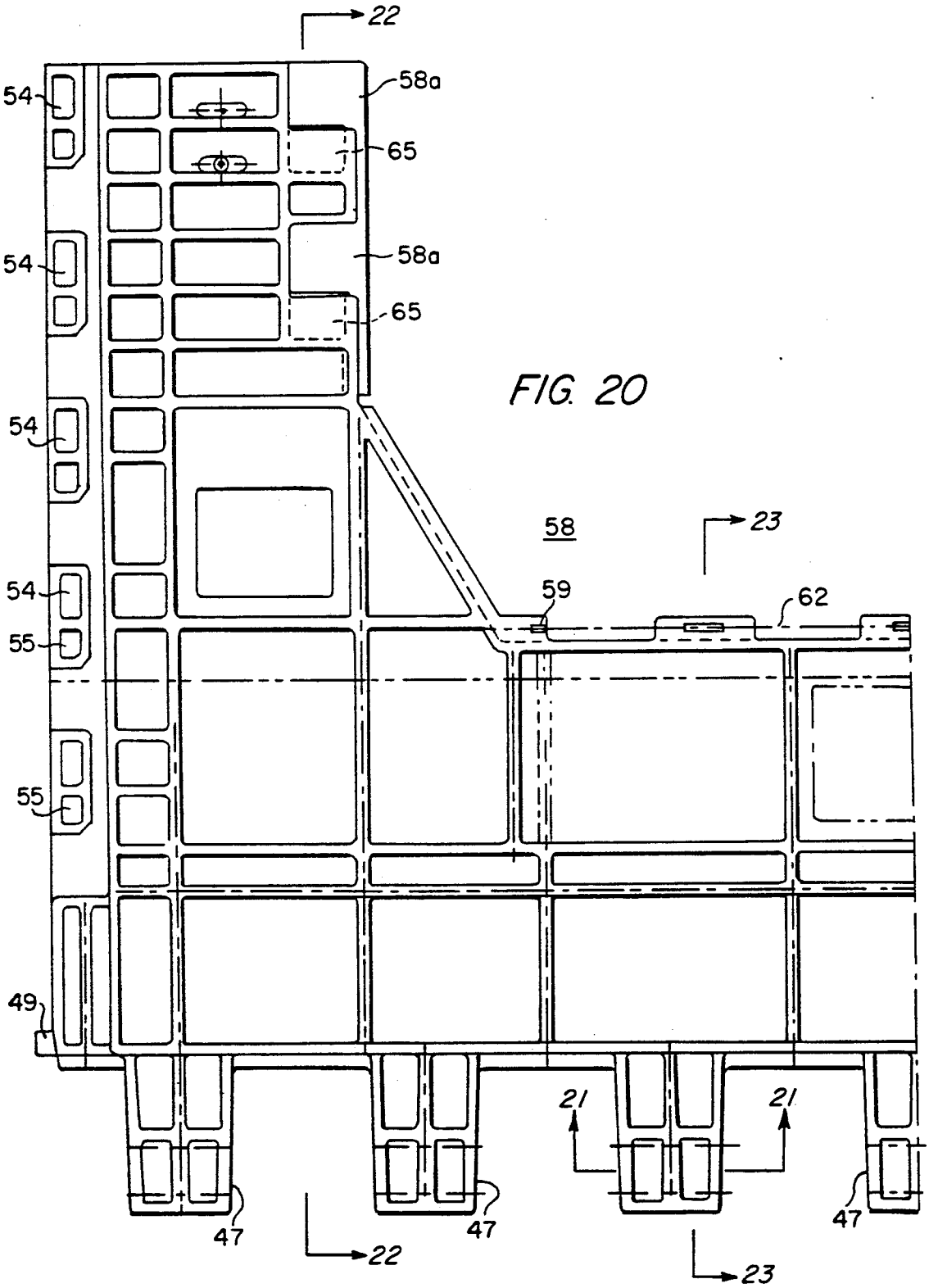
FIG. 20 is a view in elevation of one half of another side panel of the bulk box having a drop gate opening.

As shown in FIG. 20, one side panel 25 has an opening 58 for receiving the gate 60. Pockets 65 are formed in the panel along each side of the opening 58. Adjacent each of the pockets is a flange 58*a* that the gate engages during closing. FIG. 22 shows a cross-sectional view of pockets 65 and the flange 58*a*. The pockets receive corresponding hooks 61 formed along each edge of the gate in a manner similar to the way in which hooks 54 of the side panels 25, 26 are received within pockets 43 of the end panels 18.

Figure 24:
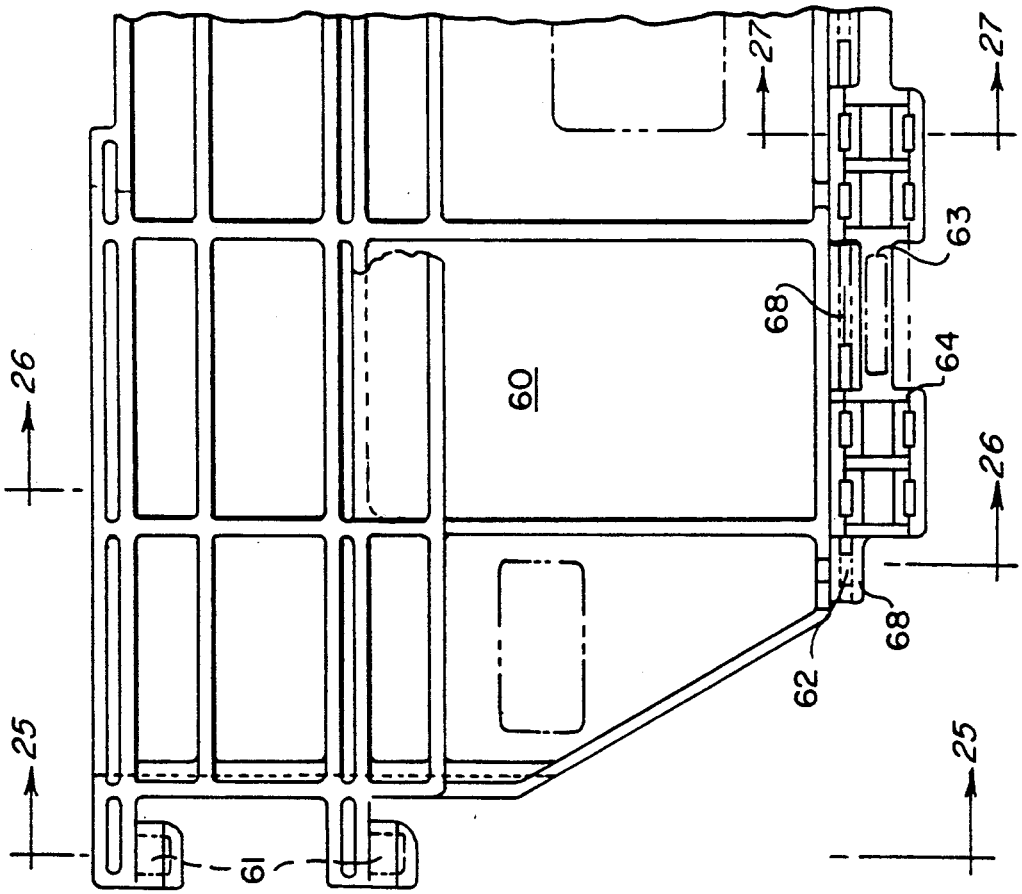
FIG. 24 is a view in elevation of one half of the drop gate that is hinged to the side panel shown in FIG. 20 with a hinge member.

The gate 60 is hinged by a hinge member 63 journaled on two hinge pins, not shown. The hinge pins have first and second axes of rotation 62 and 64, respectively, shown in FIG. 24. Depending tab portions 68 formed along the bottom edge of the gate are provided to fix one of the hinge pins to the gate. Similarly, side panel 25 has upstanding tab portions 59 along the bottom edge of the opening 58 to fix the other of the hinge pins to the side panel.

Figure 26:
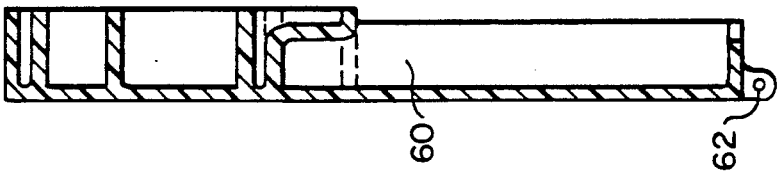
Figure 25:
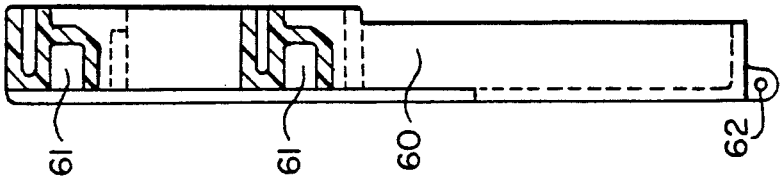

As shown in FIGS. 1, 25 and 26, the downward depending tab portions 68 are positioned at the interior side of the gate. On the other hand, the upstanding tab portions 59 are formed adjacent the exterior side of the panel, as shown in FIG. 23. Thus, the hinge member 63 provides lost motion in the vertical direction to permit gate hooks 61 to enter in and withdraw from pockets 65 formed in the edges of the opening 58 of the side panels.

The construction of the containers permits injection molding of each of the parts, and efficient production of the containers in the knock down state. In particular, as shown in FIG. 1, the containers are assembled in the knock down state after molding by hinging the side panels to the side walls of the base. After the gate is hinged to side panel 25 by means of hinge member 63, the side panels are hinged to the base. Specifically, the slots 48 of journal portions 47 of the side panels are aligned with the hinge pin axis 46 and thereafter a hinge pin is passed through to join the side panels to the base. Each of the side panels is laid flat against the base. Then, the end panels are joined to the base portion by forcing the pintles 37 of the end panels 18 down into the recesses 32 formed along the end walls 14 of the base 13.

The containers can be stacked on top of other assembled or unassembled containers. To permit stacking of containers in the knock down state, the corners of the base have corner posts 20 with outwardly facing L-shaped flanges 21 formed along an upper portion thereof. The corner feet of the base receive the L-shaped flanges 2 to permit aligned stacking of the containers. Furthermore, the corner feet can be stacked on top of an assembled container by engaging the top portions of the corners 45 formed between the side and end panels when the container is assembled for use.

Figure 28:
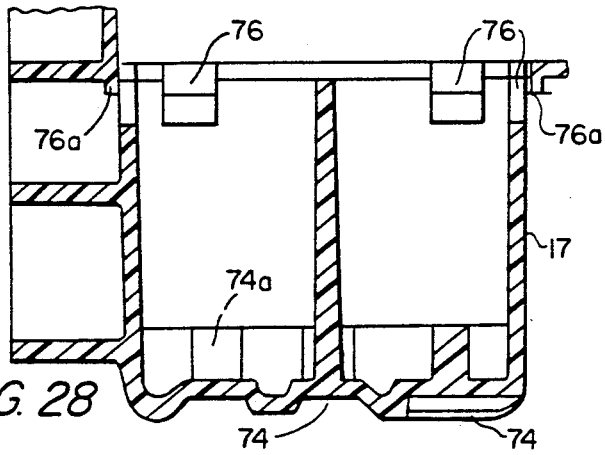
FIG. 28 is a sectional view of a portion of the base taken along line 28—28 of FIG. 2.
Figure 30:
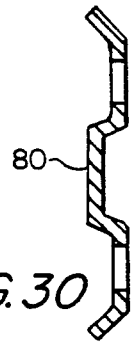
FIG. 30 is a sectional view taken along line 30—30 in FIG. 29.
Figure 29:
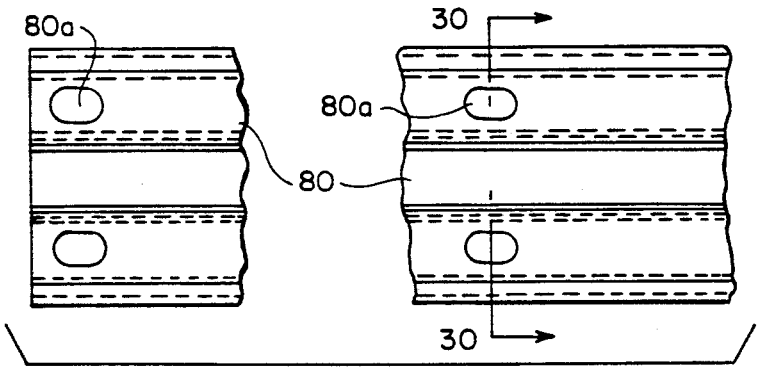
FIG. 29 is a plan view of a runner mounted to the base of the bulk box.

In FIG. 28, a cross section of one of the container feet 17 is shown. The feet are molded by being cored from the top so that the exterior of each foot has a contoured surface that engages the floor or other surface. This increases the load and impact resistance of the feet. Further, between each of the feet is a runner 80 having apertures 80*a*, as shown in FIGS. 29 and 30. The runners are attached to the feet to fit within grooves 74 that match the cross sectional shape of the runner by conventional fasteners that extend through apertures into mounting holes 74*a* formed in the bottom walls of the feet. As shown in FIGS. 1 and 3, each of the runners extends from one foot, across a second foot to a third foot along each side of the base and across the middle of the base. In this way, the runners extend around the perimeter of the base of the container and also across the middle for ensuring a uniform ground engaging support surface that can withstand sliding contact with uneven floors.

Figure 31:
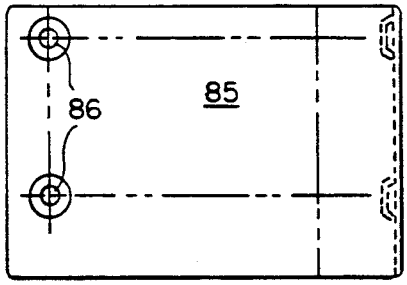
FIG. 31 is a plan view of a hit plate mounted on a foot of the base of the bulk box.
Figure 32:
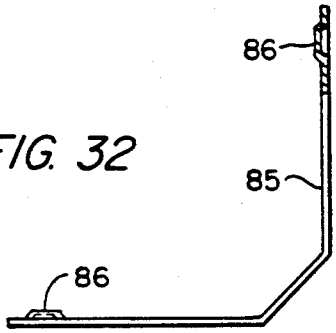
FIG. 32 is an end view, partially in section, of the hit plate shown in FIG. 31.

The feet 17 of the container permit forklift entry and handling of the containers. To support the feet 17 at the corners of the container against impact from the tines of the forklift, a hit plate 85 having apertures 86 is fixed to the walls of the feet. The hit plate is shown in FIGS. 31 and 32, and is mounted to each of the corner feet by conventional fasteners, such as screws, not shown. For this purpose, mounting holes 87, shown in FIGS. 7, 15 and 16, are molded in the side walls of the feet in positions corresponding to the apertures 86 of the hit plate.

Figure 34:
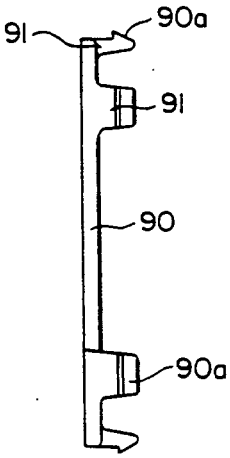
FIG. 34 is a side view of the cover plate shown in FIG. 33.
Figure 33:
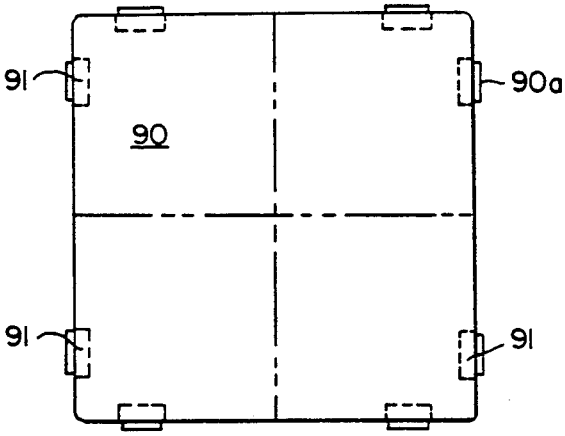
FIG. 33 is a plan view of a cover plate mounted to cover an opening of a foot in the bottom wall of the bulk box.

As shown in FIGS. 33 and 34, cover plates 90 having snap hooks 91 are provided to cover the openings in the bottom wall 16 of base 11 where the feet are located. The snap hooks are received within apertures 76 formed in bottom wall 16 adjacent the feet 17. Specifically, a shoulder 90*a* of each snap hook is dimensioned to engage a lip 76*a* adjacent each aperture 76 underneath the bottom wall 16 of the base, as shown in FIG. 29. Preferably, eight snap hooks are used to secure the cover plates to the bottom wall for covering the openings of the feet 17.

While a preferred embodiment has been described structurally and functionally in detail for the advantages thereof, other embodiments, modifications and variations are contemplated within the broad aspects of the present invention, all of which are defined by the spirit and scope of the following claims.

I claim:

1. A container having a base with base side and end walls, a pair of container end walls and a pair of container side walls wherein the container side and end walls are panels pivotally mounted to the base to lie substantially parallel with the base in an unassembled position and are swung into an upright position and joined at adjacent vertical edges to form corners of the container, comprising:

one of said pairs of side and end panels being hinged to a respective pair of base side and end walls for being first swung into an upright position;

the other of said pairs of side and end panels being mounted to said other of said base side and end walls by hinge means providing lost motion;

said one pair of panels having pockets formed along each vertically extending edge and said other pair of panels having hooks corresponding in position to said pockets formed along each vertically extending edge for engaging said pockets, said hooks being received within said pockets when both said pairs of panels are substantially in an upright position to form corner joints of the container, said hooks being seated within said pockets by downward movement of said other pair of panels with respect to said one pair of panels and said base as permitted by said hinge means; and means for lifting said other pair of panels to raise each of said other pair of panels with respect to said base as each is swung into an upright position so that said hooks are positioned above said pockets, and said means for lifting further lowering each of said other pair of panels with respect to said one pair of panels when said hooks and said pockets are substantially aligned with one another to allow said hooks to be seated within said pockets to form the corner joints.

2. The container according to claim 1, wherein said lifting means comprises pins extending outwardly from each of said vertically extending edges of each of said other pair of panels and groove means adjacent to each of said pins for receiving and guiding said pins to lift each of said other pair of panels with respect to said base as each of said other pair of panels is swung into the upright position.

3. The container according to claim 1, further comprising each of said one pair of panels being snapped into hinged engagement with a corresponding base side or end wall; each said panel having a pintle body extending downwardly and having two pins extending outwardly therefrom; and said corresponding base wall having a pocket for each of said pintle bodies with resilient deformable flanges that engage said pins as said pintle body is forced downwardly int said pocket, said pins resiliently forcing said flanges apart until said pins pass said flanges allowing them to flex inwardly toward one another to engage said pintle body and said pins therein between for preventing said pintle body from being disengaged from said pocket.

4. A container according to claim 3, wherein said base has a buttress flange extending upwardly within said pocket for buttressing said pintle body.

5. The container according to claim 4, wherein said pintle body has an opening between said pins for receiving said buttress flange and has a rounded bottom base engagement surface adjacent each of said pins for engaging a corresponding grooved surface of said base end wall to permit one pair of said panels to be rotated with said surfaces engaging.

6. A container according to claim 1, wherein said base has upstanding corner posts at each of the corners of the base with outwardly facing L-shaped flanges and said base having feet at each of said corners at a bottom portion of the base, wherein said L-shaped flanges receive corresponding structure of said feet for permitting stacking of said containers in an unassembled state; and each of said corners of an assembled container having an outwardly facing L-shaped corner structure to permit interstacking of assembled and unassembled containers.

7. A container according to claim 1, wherein said other of said pair of end and side panels has a drop gate hingedly mounted to the panel for permitting access to an interior of the container, said drop gate having means for engaging said panel along its edges for securing said drop gate to said panel without a latch.

8. A container according to claim 1, further comprising:

said container being molded of a synthetic resin material and having a plurality of feet extending downwardly from said base that are mold cored from the top to leave open top portions of the feet in a bottom wall of the base; and a plurality of cover plates having means for mounting said cover plates to said bottom wall of the base to cover said open top portions.

9. A container according to claim 8, further comprising:

a plurality of runners extending between predetermined ones of said feet, each of said runners being of a uniform length and having a cross-sectional shape; and each of said feet having a shape in its bottom wall matching said cross-sectional shape for receiving said runners.

10. A container according to claim 8, wherein each of said feet at the corners of said container has a hit plate mounted on its exterior walls.

11. A container having a base with base side and end walls, a pair of container end walls and a pair of container side walls wherein the container side and end walls are panels pivotally mounted to the base to lie substantially parallel with the base in an unassembled position and are swung into an upright position and joined at adjacent vertical edges to form corners of the container, comprising:

one of said pairs of side and end panels being hinged to a respective pair of base side and end walls for being first swung into an upright position;

the other of said pairs of side and end panels being mounted to said other of said base side and end walls by hinge means providing lost motion;

said one pair of panels having one of pockets and hooks and said other pair of panels having one of said pockets and said hooks that correspond in position for engagement when said pairs of panels are in a substantially upright position to form corner joints between adjacent ones of said panels, said hooks and said pockets being engaged by downward movement of said other pair of panels with respect to said one pair of panels and said base, said downward movement being permitted by said hinge means; and means for lifting said other pair of panels to raise each of said other pair of panels as each is swung into the upright position so that one of said hooks and said pockets are positioned above the other, and said means for lifting further lowering each of said other pair of panels with respect to said one pair of panels when said hooks and pockets are substantially aligned with one another so that said hooks engage said pockets to form the corner joints.

12. The container according to claim 11, wherein said pockets face inwardly and open upwardly and are formed along each vertically extending edge of said one pair of panels and said hooks face outwardly and point downwardly and are formed along each vertically extending edge of each of said other pair of panels such that said hooks engage said pockets by being lowered into said pockets by said lifting and lowering means.

13. The container according to claim 11, wherein said lifting means comprises at least one pin extending outwardly from a side of each of said other pair of panels and groove means for receiving said at least one pin to lift said panels with respect to said base as said panels are swung into the upright position, said groove means further having a shape that permits said at least one pin to drop downwardly when said other pair of panels are in the upright position.

14. The container according to claim 13, wherein said groove means is formed in one of said base side and end walls adjacent said at least one pin.

15. The container according to claim 11, wherein said hinge means hinges a lower edge of each of said other panels to a top edge of said other of said base side and end walls.

16. The container according to claim 11, wherein said hinge means includes said each of said other pair of panels having an elongated slot extending in a direction perpendicular to said base when said other pair of panels is in the upright position, said elongated slot receiving a hinge pin fixed to said base.

17. A container having a base with base side and end walls, a pair of container end walls and a pair of container side walls wherein the container side and end walls are panels pivotally mounted to the base to lie substantially parallel with the base in an unassembled position and are swung into an upright position and joined at adjacent vertical edges to form corners of the container, comprising:

one of said pairs of side and end panels being hinged to a respective pair of base side and end walls for being first swung into an upright position;

the other of said pairs of side and end panels being mounted to said other of said base side and end walls by hinge means providing lost motion;

said one pair of panels having pockets and said other pair of panels having hooks corresponding in position to said pockets for engaging said pockets when said pairs of panels are in a substantially upright position to form corner joints between adjacent ones of said panels, one of said hooks and said pockets being seated within the other by downward movement of said other pair of panels with respect to said one pair of panels and said base, said downward movement being permitted by said hinge means;

each of said other pairs of panels having at least one pin extending outwardly from at least one corresponding side of each side panel and spaced from said hinge means; and one of said one pair of panels and said base having a track for receiving each said at least one pin, said track having a shape that guides said at least one pin to lift said panel as each said other pair of panels is swung into the upright position for vertically positioning said hooks above said pockets, and said track further having a shape that guides said at least one pin to lower each of said other pair of panels when said hooks and pockets are substantially aligned to seat said hooks within said pockets for forming the corner joints.

18. The container according to claim 17, wherein said other pair of panels has pins extending from each said side of said panels and said one of said one pair of panels and said base has one said track formed adjacent each of said pins for guiding said pins.

19. The container according to claim 18, wherein said track is formed in said base.

20. The container according to claim 2, wherein said groove means comprises a first groove adjacent a first one of said pins and a second groove adjacent a second one of said pins, each of said grooves being formed in one of said base side and end walls.

* * * * *